US006951291B2

(12) United States Patent
Kleanthis

(10) Patent No.: US 6,951,291 B2
(45) Date of Patent: Oct. 4, 2005

(54) DISPLAY SYSTEM

(76) Inventor: George Kleanthis, 3107 Aviara Ct., Naperville, IL (US) 60564

( * ) Notice: Subject to any disclaimer, the term of this patent is extended or adjusted under 35 U.S.C. 154(b) by 44 days.

(21) Appl. No.: 10/692,372

(22) Filed: Oct. 23, 2003

(65) Prior Publication Data

US 2004/0226240 A1 Nov. 18, 2004

Related U.S. Application Data

(60) Provisional application No. 60/420,664, filed on Oct. 23, 2002.

(51) Int. Cl.[7] ..... A47F 5/02; A47G 29/00; G09F 21/04

(52) U.S. Cl. ..... 211/163; 211/78; 40/593

(58) Field of Search ..... 211/78, 163, 95, 211/189; 40/593, 502, 503, 606.01, 606.03, 40/604, 506

(56) References Cited

U.S. PATENT DOCUMENTS 2,750,051 A * 6/1956 Wassell ..... 211/78
2,831,420 A * 4/1958 Radman ..... 211/163
3,105,315 A * 10/1963 Snethen ..... 40/502
3,942,647 A * 3/1976 Crosslen ..... 211/144
4,030,608 A * 6/1977 Howard ..... 211/131.1
4,262,439 A * 4/1981 Dinan et al. ..... 40/606.03
4,442,942 A * 4/1984 Cuminale et al. ..... 211/163
4,895,260 A * 1/1990 Ancona et al. ..... 211/77
5,226,548 A * 7/1993 Koeppel ..... 211/144
5,607,065 A * 3/1997 Todd ..... 211/40
5,628,413 A * 5/1997 Lu et al. ..... 211/13.1
6,148,552 A * 11/2000 Dumontier et al. ..... 40/473
6,189,710 B1 * 2/2001 Mason ..... 211/131.1
6,564,953 B2 * 5/2003 Ascik ..... 211/189
6,585,118 B2 * 7/2003 Kellogg ..... 211/13.1
6,789,686 B2 * 9/2004 Bennett et al. ..... 211/40
6,802,143 B1 * 10/2004 Rachowitz et al. ..... 40/502

* cited by examiner

*Primary Examiner*—Hugh B. Thompson, II
(74) *Attorney, Agent, or Firm*—Marshall, Gerstein & Borun LLP

(57) ABSTRACT

A display system for a shopping mall or retail store environment includes a platform, a plurality of kiosks mounted on the platform, each of the kiosks including a base, a raised drum having a plurality of lights arranged in two concentric sets, and at least three panels illuminated by the lights and disposed between the base and the drum and extending radially outwardly from a central vertical axis, a podium disposed adjacent the platform and defining a workstation, a first spar connecting the drum of a first kiosk with the drum of a second kiosk, and a second spar connecting the drum of the first kiosk with the podium, with each of the first and second spars including a first end, a second end, and an uninterrupted display surface extending from adjacent the first end to adjacent the second end, the display surface arranged to receive indicia, each of the first and second spars further arranged to support electrical cable to thereby permit an electrical connection between each of the kiosks and the podium.

20 Claims, 5 Drawing Sheets

DISPLAY SYSTEM

RELATED APPLICATIONS

This application claims priority under 35 U.S.C. § 119(e) from U.S. Provisional Application Ser. No. 60/420,664, filed Oct. 23, 2002.

FIELD OF THE INVENTION

The present invention relates to store fixtures and, more particularly, to a display system for use in a shopping mall or in a retail store environment.

BACKGROUND OF THE INVENTION

In shopping malls and in other retail store environments, great care is often exercised when planning the display of certain items or services for sale in order to maximize traffic volume and in order to maximize the amount of information that can be conveyed to a potential customer in the least amount of time. For example, in many retail store or shopping mall environments available floor space is at a minimum. Moreover, ambient lighting and traffic patterns may not be conducive to causing a potential customer to stop and/or linger at a particular display. Additionally, consumers are constantly bombarded with advertising pitches in retail environments, and thus there is a continuing need for display systems that are new and distinctive in order to attract the maximum amount of potential customers.

One consideration when determining if a particular display system may be distinctive and hence advantageous over competing systems is whether the particular display system displays the products and/or services for sale in a user-friendly and attractive manner. Is generally well excepted that, when a system is more user-friendly and attractive, potential customers will spend much greater time perusing the products and/or services being displayed, with the end result being greater likelihood that a sale will be made.

In almost all areas involving the sale of products and/or services in retail and shopping mall environments, the competition is greater than ever before. A more pleasing and attractive shopping environment, coupled with a user-friendly atmosphere, creates a more enjoyable shopping experience and increases the chances that a particular consumer will make one or more return visits. It is generally well accepted that a consumer will not return to an unattractive and unpleasant shopping area.

In view of the foregoing, there remains a continuing need for improved display systems in retail store and shopping mall environments.

DETAILED DESCRIPTION OF THE PREFERRED EMBODIMENTS

The examples described herein are not intended to be exhaustive or to limit the scope of the invention to the precise form or forms disclosed. Rather, the following exemplary embodiments have been chosen and described in order to best explain the principles of the invention and to enable others skilled in the art to follow the teachings thereof.

Figure 1:
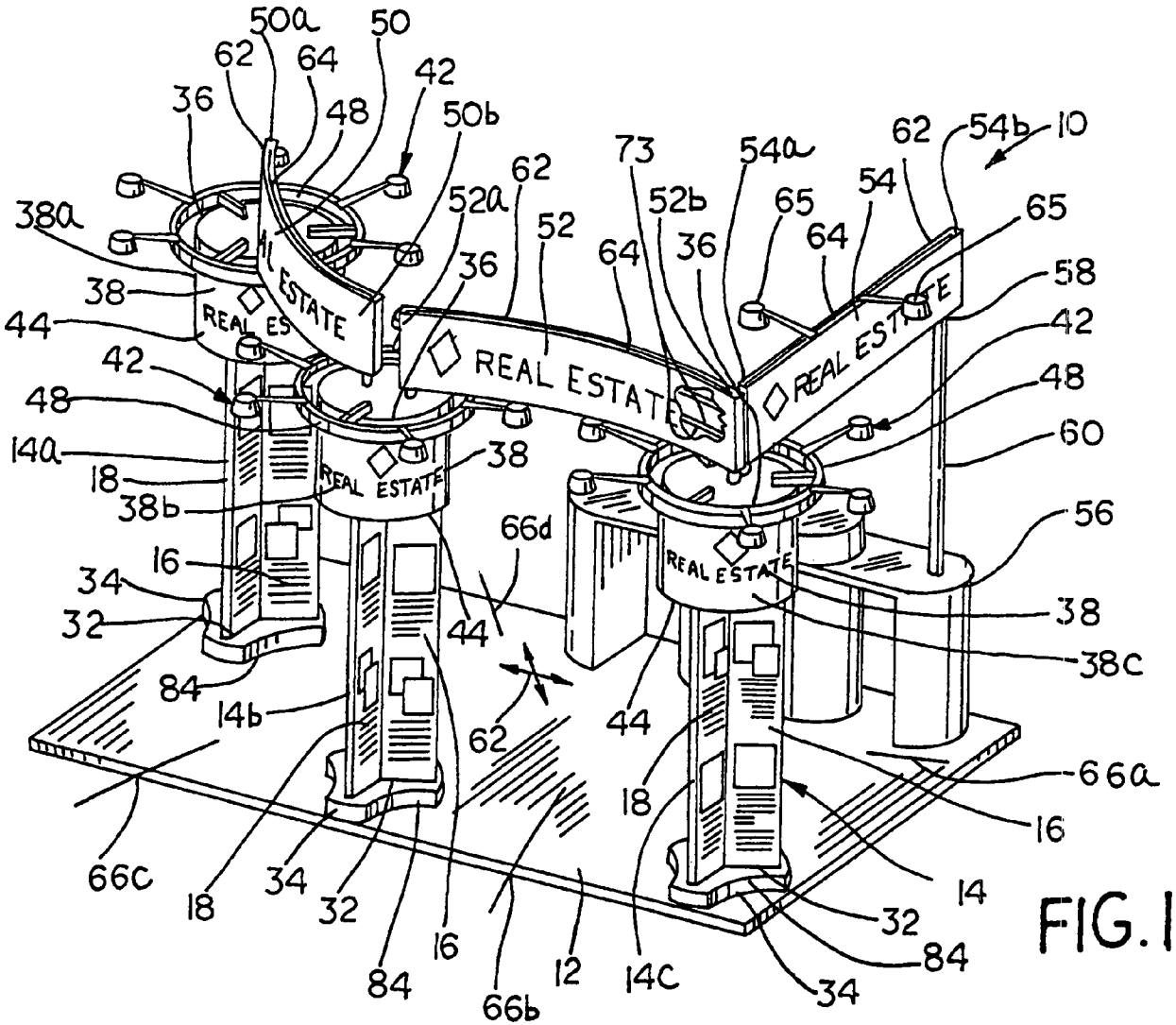
FIG. 1 is a perspective view of a display system assembled in accordance with the teachings of the present invention.
Figure 2:
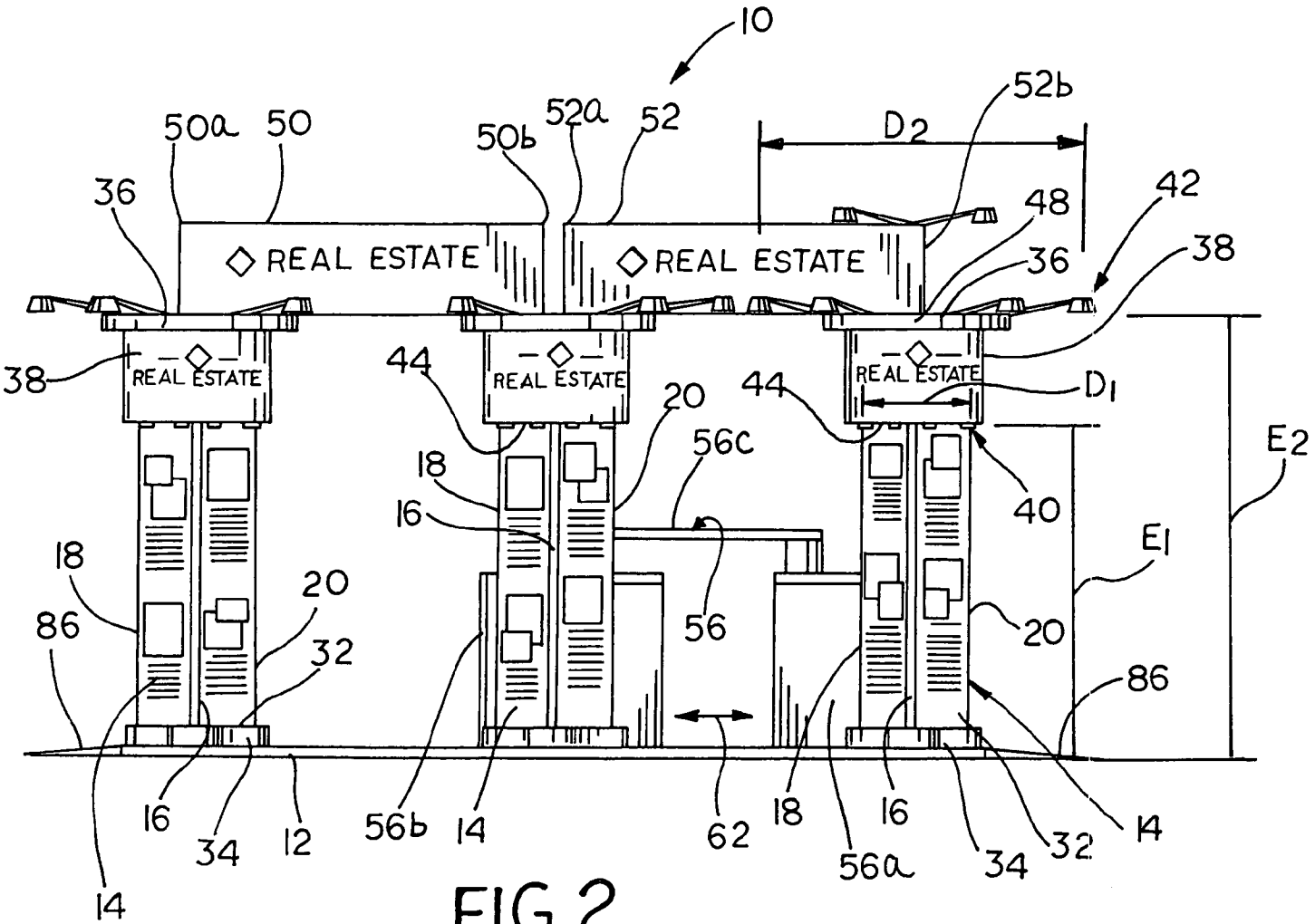
FIG. 2 is an elevational view thereof.
Figure 3:
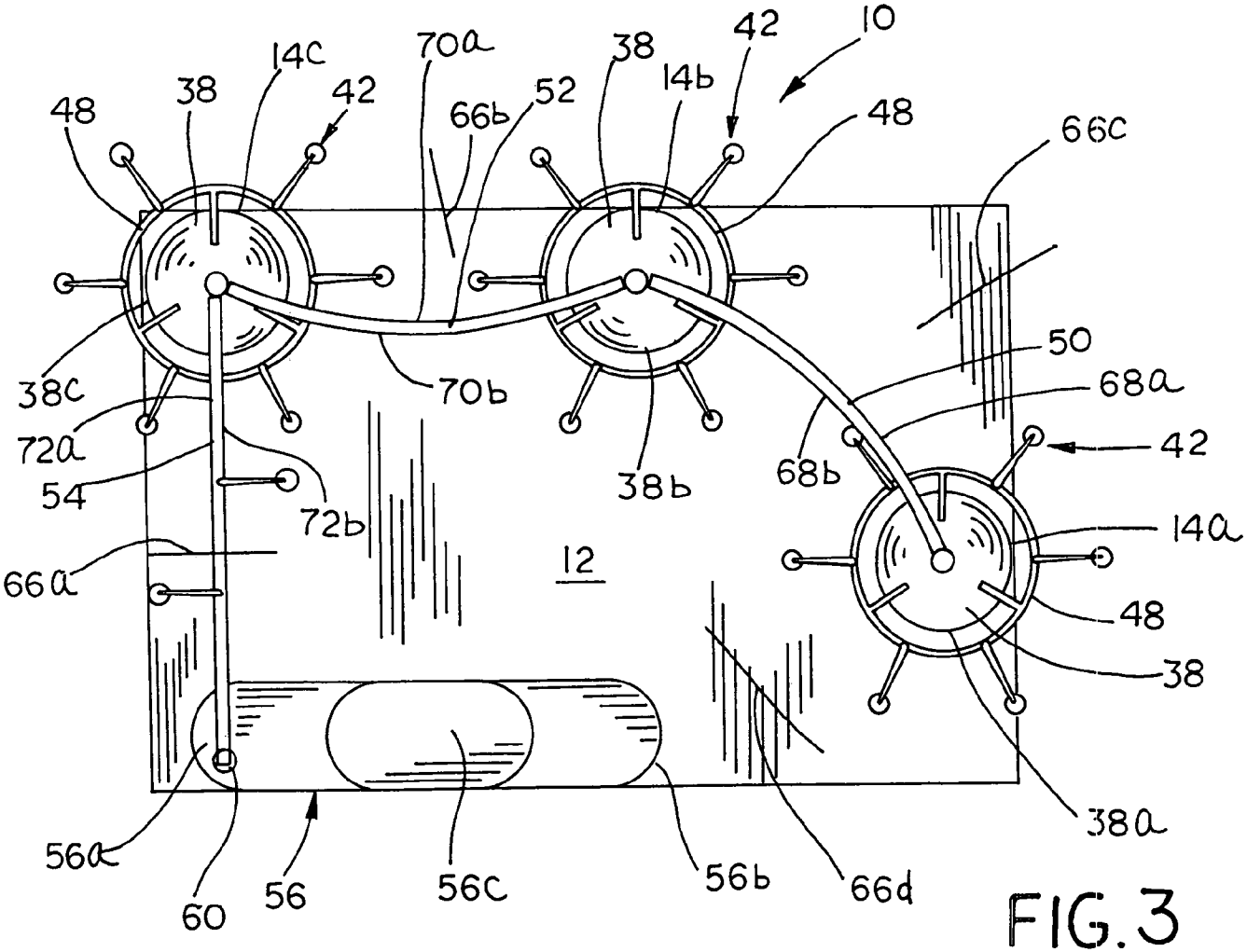
FIG. 3 is a top plan view thereof.

Referring now to FIGS. 1–3 of the drawings, a display system assembled in accordance with the teachings of a first disclosed example of the present invention is generally referred to by the reference numeral 10. The display system 10 includes a platform 12 and a plurality of kiosks 14. In the disclosed example, three individual kiosks are shown, which will be referred to as the kiosks 14*a*, 14*b* and 14*c*. It will be appreciated that a greater or fewer number of kiosks 14 may be employed, including only a single kiosk 14. It will be understood that the platform 12 may be formed from existing floor space in the retail or shopping mall environment. As an alternative, the platform 12 may be a separate structure.

For purposes of convenience, only the structure of an individual kiosk will be discussed in detail herein, it being understood that the other kiosks are substantially similar to the one described in detail. Each kiosk 14 includes a plurality of display panels 16, 18, and 20 (the display panel 20 is obscured in FIGS. 1–3 and is best visible in FIGS. 4 and 5). Each panel forms a pair of oppositely facing display surfaces. More specifically, the display panel 16 forms the display surfaces 16*a* and 16*b*, the display panel 18 forms the display surfaces 18*a* and 18*b*, and the display panel 20 forms the display surfaces 20*a* and 20*b*.

Figure 5:
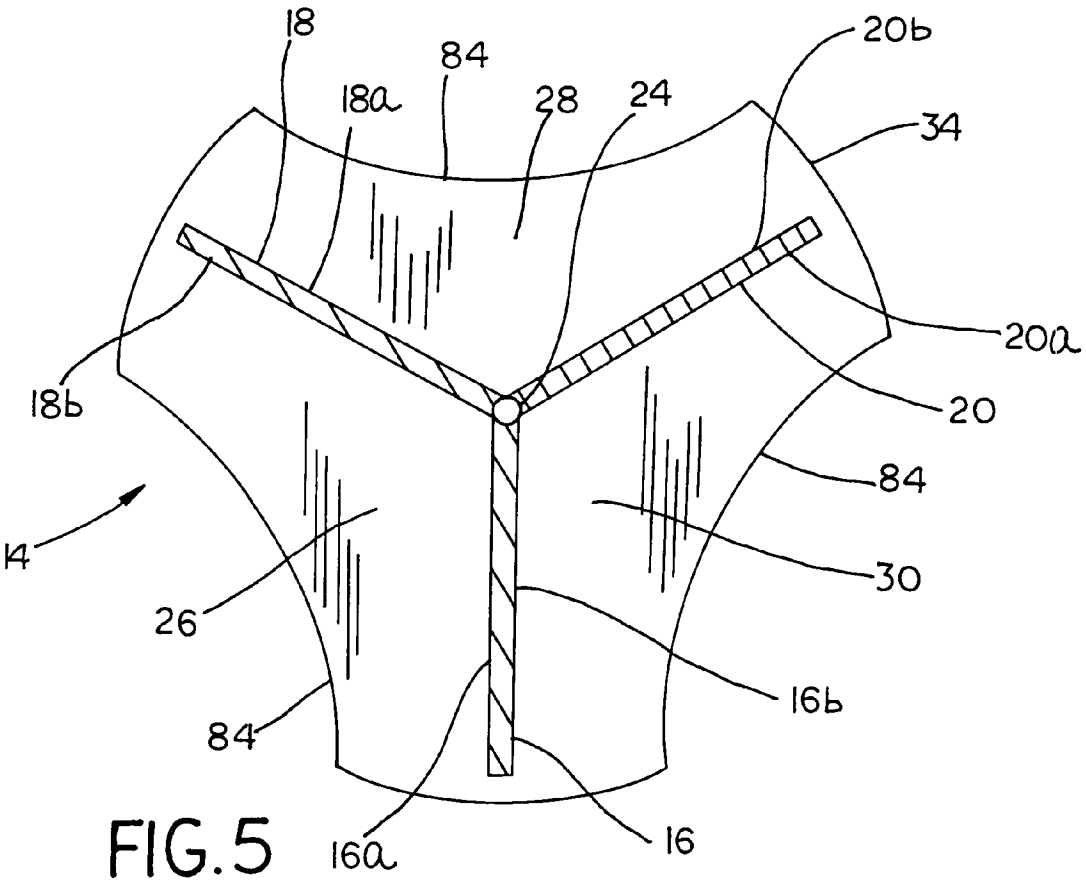
FIG. 5 is an enlarged fragmentary cross-sectional view taken along line 5—5 of FIG. 3.

As can be seen in FIG. 5, the display panels 16, 18 and 20 extend radially outwardly from a central axis 22 of the kiosk 14. In the disclosed example, the central axis 22 is formed by a central post 24 or other suitable support. Further, it will be appreciated that, in the disclosed example, the panels 16, 18, and 20 are spaced apart relative to each other approximately 120°, with each panel cooperating with the next adjacent panel to form a plurality of viewing bays 26, 28 and 30.

More specifically, and referring still to FIG. 5, the viewing bay 26 is defined by the surface 16*a* of the panel 16 and by the surface 18*b* of the panel 18. Similarly, the bay 28 is defined by the surface 18*a* of the panel 18 and the surface 20*b* of the panel 20. Finally, the bay 30 is defined by the surface 20*a* of the panel 20 and the surface 16*b* of the panel 16.

Figure 4:
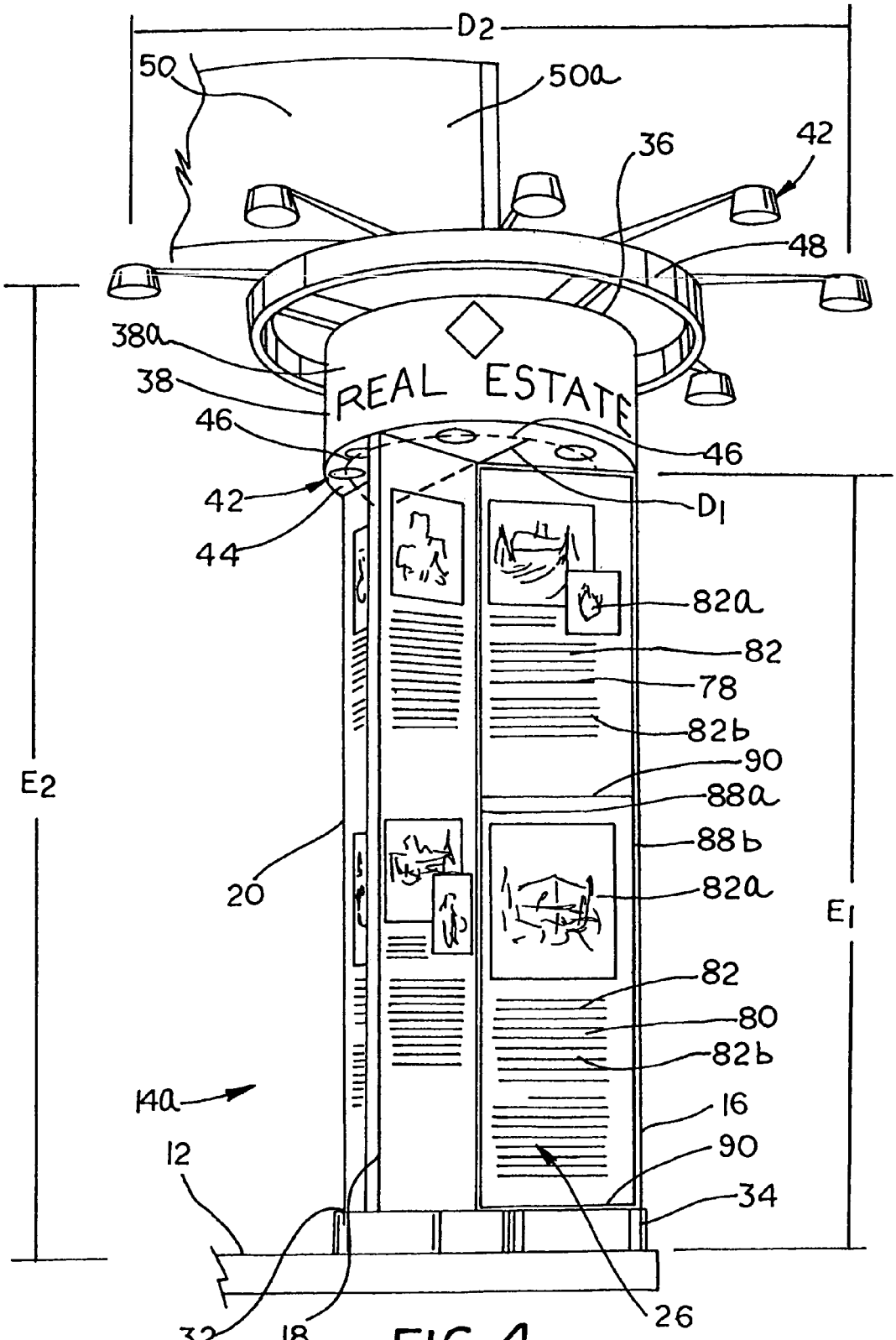
FIG. 4 is an enlarged view in perspective of a representative kiosk.

As shown in FIGS. 1, 2 and 4, the kiosk 14 includes a lower end 32 forming a base 34, and an upper end 36 having a drum 38. In the disclosed example, the drum 38 is preferably cylindrical. The panels 16, 18 and 20 are disposed between the base 34 and the drum 38. Preferably, the base 34 is sufficiently short such that the panels 16, 18, and 20 extend nearly all the way to the surface of the platform 12 so as to, in the disclosed example, maximize the amount of surface area available on the panels 16, 18 and 20.

As best shown in FIGS. 2 and 4, the kiosk 14 includes a first set of lights 40 and a second set of lights 42. In the disclosed example, the first set of lights 40 are disposed in a lower surface 44 of the drum 38, such that the first set of lights 40 may be positioned to shine generally downwardly so as to illuminate the panels 16, 18 and 20. Still preferably, the first set of lights 40 may be recessed within the lower surface 44 of the drum 38. Still preferably, as shown in FIGS. 2 and 4, the first set of lights 40 are arranged generally in a ring 46 having a diameter $D_1$. Further, the first set of lights 40 are preferably disposed at an elevation $E_1$ above the surface of the platform 12. Similarly, the second set of lights 42 preferably are arranged about a ring 48 mounted to the drum 38 so as to have a diameter $D_2$, with the second set of lights 42 preferably disposed at an elevation $E_2$ above the surface of the platform 12.

As shown in FIGS. 1–3 the display system 10 also preferably includes a plurality of spars 50, 52 and 54 (the spar 54 is only visible in FIGS. 1 and 3). In the disclosed example, the spar 50 interconnects the kiosk 14*a* and the kiosk 14*b*, while the spar 52 interconnects the kiosk 14*b* and the kiosk 14*c*. The spar 54 interconnects the kiosk 14*c* and a podium 56. In the disclosed example, the podium 56 is elongate and has a pair of ends 56*a* and 56*b*, and a raised center 56*c*. It will be appreciated that the spar 50 includes an end 50*a* joined to the drum 38 on the kiosk 14*a*, and an end 50*b* join to the drum 38 on the kiosk 14*b*. The spar 52 includes an end 52*a* joined to the drum 38 on the kiosk 14*b*, and an end 52*b* join to the drum 38 on the kiosk 14*c*. Similarly, the spar 54 includes an end 54*a* joined to the drum 38 on the kiosk 14*c*, and an end 54*b* joined to an upper end 58 of a post 60 connected to the podium 56.

As shown in FIG. 1, each of the spars 50, 52 and 54 is provided with a raceway or conduit 62 sufficient to enable electrical cable 64 to be routed from a suitable electrical supply source (not shown) through the display system 10 as desired. More specifically, in the event a suitable supply source is disposed adjacent the podium 56, the provision of the conduits 62 through the spars 50, 52 and 54 enables the electrical cable 64 to extend from the source and illuminate the first and second sets of lights 40 and 42 (and also to provide power to any other accessories desired by the user), without having to have electrical cables routed across or underneath the platform 12.

Referring now to FIGS. 1 and 3, it can be seen that the kiosks 14*a*, 14*b*, and 14*c* are arranged on the platform 12 relative to the podium 56 so as to define the traffic area 62. It will be appreciated that the traffic area 62 may be illuminated, at least in part, by the first set of lights 40 and/or the second set of lights 42. Additional lights, such as a set of lights 65 which, in the disclosed example, are supported by the spar 54. Still further lights may be provided as desired. Also, it will be appreciated that, in the disclosed example, the kiosks and the podium may be arranged to define a number of pathways 66*a*, 66*b*, 66*c*, and/or 66*d* leading from the surrounding area onto the platform 12 thus intersecting the traffic area 62.

As shown in FIGS. 1 and 3, one or more of the spars 50, 52 and/or 54 may be curved. In the disclosed example, with only the spars 50 and 52 are curved. Further, the curved spars 50 and 52 may be a simple curved as shown, or a more complex curve, such as an "S" curve when viewed in plan. Still other configurations may be chosen. Each of the spars 50, 52 and 54 defines a pair of display surfaces. More specifically, the spar 50 defines a pair of display surfaces 68*a* and 68*b*, the spar 52 defines a pair of display surfaces 70*a* and 70*b*, and the spar 54 defines a pair of display surfaces 72*a* and 72*b*.

It will be appreciated that, in the disclosed example, each of the display surfaces 68*a* and 68*b*, 70*a* and 70*b*, and 72*a* and 72*b* form a generally uninterrupted and continuous surface extending between roughly adjacent the ends of the spars 50, 52 and 54. In the disclosed example, the display surfaces 68*a*, 68*b*, 70*a*, 70*b*, 72*a* and 72*b* are arranged to receive indicia in the form of text and/or numerals or any other suitable indicia intended to convey a message and/or other information to a potential consumer. Still further, in the disclosed example, may include an internal lighting system 74, and each of the display surfaces 68*a*, 68*b*, 70*a*, 70*b*, 72*a* and 72*b* may be provided with a translucent portion, such that each of the display surfaces 68*a*, 68*b*, 70*a*, 70*b*, 72*a* and 72*b* may be suitably backlit, such as by a light fixture 73 disposed between the surfaces of the spars.

In the disclosed example, preferably each of the drums 38 will include a display surface 38*a*, 38*b*, and 38*c*. The display surfaces 38*a*, 38*b*, and 38*c* are arranged to receive indicia in the form of text and/or numerals or any other suitable indicia intended to convey a message and/or other information to a potential consumer.

A shown in FIGS. 1, 2, and 4, each of the display surfaces 16*a*, 16*b*, 18*a*, 18*b*, 20*a* and 20*b* may be divided into a number of distinct areas. For example, and referring now to FIG. 4, it can be seen on the kiosk 14 that the display surface 16*a* includes an upper area 78 and a lower area 80. It will be appreciated that the display surface 16*a* may be divided into still further distinct areas as desired by the user. It will also be appreciated that, in the disclosed example, each of the other display surfaces on the same kiosk and/or on other kiosks may be similarly divided into distinct areas. However, for the purposes of convenience, only the areas 78 and 80 on the kiosk 14 need be described in detail herein. It can be seen that each of the areas 78 and 80 are adapted to receive indicia 82. In the disclosed example, the indicia 82 may include pictures 82*a* and/or text 82*b*, or any other indicia intended to convey a message or information to a potential consumer. In the disclosed example, it may be advantageous to maximize the amount of user-friendly visual information, such as in the form of picture or graphics, while perhaps minimizing the amount of text. Still further, each of the areas 78 and 80 may be adapted to provide a variety of visual images, such as through the provision of a video display unit such as a flat panel screen. It will be appreciated that the indicia on each of the areas 78 and 80 may be readily removable and replaceable with additional and/or different indicia as desired. Thus, each of the areas 78 and 80 may be provided with a suitable cover, such as a clear plexiglass cover. Preferably, and as shown in FIG. 4, each panel may be provided with a pair of vertical retaining channels or rails 88*a* and 88*b*, and further may be divided into a plurality of areas (two such areas being shown to the right of FIG. 4), with one or more channels or cross members 90 mounted between the rails 88*a* and 88*b* and forming a resting place to receive a portion of the graphic display. Alternatively, the indicia may be secured to the areas 78 and 80 in any known fashion which would be readily known to those of skill in the art.

As shown in FIGS. 1 and 5, the base of 34 of each kiosk 14 may be provided with an indentation 84. This indentation 84 enables a potential consumer to stand closer to the appropriate viewing bay 26, 28 and/or 30, making the display system 10 more user-friendly. Also, the vertical extent of each kiosk 14 may be chosen to maximize the total available surface area. Further, the height of the drums 38 above the platform 12 may be chosen such that the upper display area 78 is roughly at eye-level, or slightly above, for most consumers. Preferably, the base 34 of each kiosk 14 is relatively shallow, such as in the neighborhood of four (4) inches. In the disclosed example, the top of each drum 38 is roughly eight to eight and one half feet (96 inches to 102 inches) inches off the surface of the platform 12. Other heights may prove suitable.

It will be appreciated that certain exemplary details of the display system 10 discussed herein may be varied. For example, the podium 56 may be placed on the platform 12 or closely adjacent to the platform 12. Still further, additional or fewer kiosks 14 may be provided, and the location of the kiosks 14 on the platform 12 may be adjusted as desired in order to control the flow of traffic through the traffic area 62. Finally, the platform 12 may be provided with one or more ramps 86 (FIG. 2) in the event the platform 12 is a separate structure.

It will be appreciated that details of the various embodiments discussed herein are not intended to be mutually exclusive. Thus, various aspects and details of the disclosed examples may be interchanged, eliminated, and/or substituted.

Numerous additional modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed is:

1. A display system comprising:

a platform;

a plurality of kiosks mounted on the platform, each of the kiosks including a base, a raised drum, and at least three panels disposed between the base and the drum and extending radially outwardly from a central vertical axis;

the drum including a plurality of lights positioned to illuminate the panels;

a podium disposed adjacent the platform and defining a workstation, the podium including an upright;

a first spar connecting the drum of a first kiosk with the drum of a second kiosk;

a second spar connecting the drum of the first kiosk with the upright; and each of the first and second spars including a first end, a second end, and an uninterrupted display surface extending between the first end and the second end, the display surface arranged to receive indicia, each of the first and second spars further arranged to support electrical cable to thereby permit an electrical connection between each of the kiosks and the podium.

2. The display system of claim 1, wherein the drum includes a bottom surface and wherein the lights are disposed adjacent the bottom surface.

3. The display system of claim 1, wherein each of the panels includes a first display surface and a second display surface, the first display surface of a first one of the panels cooperating with the second display surface of an adjacent second one of the panels to define a viewing bay.

4. The display system of claim 3, wherein the viewing bay is defined in part by a 120 degree angle between the first panel and the adjacent second panel.

5. The display system of claim 1, including a light support mounted adjacent an upper end of the drum.

6. The display system of claim 5, wherein the drum comprises a cylinder and wherein the light support comprises a ring, the ring including an axis disposed concentrically with an axis of the cylinder.

7. The display system of claim 6, wherein the ring is spaced outwardly relative to an outer surface of the cylinder.

8. The display system of claim 7, including a plurality of ribs mounted to the ring, each of the ribs supporting a light fixture.

9. A display system comprising:

a platform;

a plurality of kiosks mounted on the platform, each of the kiosks including a base, a raised drum, and at least three panels disposed between the base and the drum and extending radially outwardly from a central vertical axis;

the drum including a first set of lights and a second set of lights, the first and second sets of lights positioned to illuminate the panels and at least a portion of the platform;

a podium disposed adjacent the platform and defining a workstation, the podium including an upright;

a first spar connecting the drum of a first kiosk with the drum of a second kiosk;

a second spar connecting the drum of the first kiosk with the upright; and each of the first and second spars including a first end, a second end, and an uninterrupted display surface extending from adjacent the first end to adjacent the second end, the display surface arranged to receive indicia, each of the first and second spars further arranged to support electrical cable to thereby permit an electrical connection between each of the kiosks and the podium.

10. The display system of claim 9, wherein the drum includes a bottom surface and wherein the first set of lights are disposed adjacent the bottom surface and arranged in a first ring.

11. The display system of claim 10, wherein the second set of lights are arranged in a second ring, the second ring having a diameter greater than the first ring.

12. The display system of claim 11, wherein the first ring is disposed at a first elevation above the platform and the second ring is disposed at a second elevation above the platform.

13. The display system of claim 12, wherein the second ring includes a plurality of mounting ribs, the second set of lights mounted to the mounting ribs.

14. The display system of claim 13, wherein the first and second rings are concentric.

15. The display system of claim 9, wherein each of the panels includes a first display surface and a second display surface, the first display surface of a first one of the panels cooperating with the second display surface of an adjacent second one of the panels to define a viewing bay, the viewing bay comprising a 120 degree angle between the first panel and the second panel.

16. The display system of claim 9, wherein at least one of the spars includes a plurality of lights arranged to illuminate the podium.

17. The display system of claim 9, wherein a portion of the platform is elevated above a support surface, and wherein at least a portion of the platform forms a ramp angled to meet the support surface.

18. The display system of claim 17, wherein the kiosks are arranged on the platform relative to the podium to define a traffic area between the kiosks and the podium.

19. The display system of claim 9, wherein the podium is disposed on the platform.

20. A display system comprising:

a platform;

a plurality of kiosks mounted on the platform, each of the kiosks including a base, a raised drum, and at least three panels disposed between the base and the drum and extending radially outwardly from a central vertical axis, the panels cooperating to form a plurality of display bays on each of the kiosks;

the drum including a first ring of lights disposed at a first elevation and a second ring of lights disposed at a second elevation, the first and second rings of lights generally concentric and positioned to illuminate the panels and at least a portion of the platform;

a podium disposed adjacent the platform and defining a workstation, the podium including an upright, the kiosks disposed relative to the platform and the podium to define a traffic area between the kiosks and the podium;

a first spar connecting the drum of a first kiosk with the drum of a second kiosk;

a second spar connecting the drum of the first kiosk with the upright; and each of the first and second spars including a first end, a second end, and an uninterrupted display surface extending from adjacent the first end to adjacent the second end, the display surface arranged to receive indicia and adapted to be backlit, each of the first and second spars further arranged to support electrical cable to thereby permit an electrical connection between each of the kiosks and the podium.

* * * * *